US006981547B2

(12) United States Patent
Maguire et al.

(10) Patent No.: US 6,981,547 B2
(45) Date of Patent: Jan. 3, 2006

(54) WIRE LOCK EXPANDABLE CONNECTION

(75) Inventors: Patrick G. Maguire, Cypress, TX (US); David E. Hirth, Pasadena, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 14 days.

(21) Appl. No.: 10/313,920

(22) Filed: Dec. 6, 2002

(65) Prior Publication Data

US 2004/0108119 A1 Jun. 10, 2004

(51) Int. Cl.
*E21B 17/02* (2006.01)
*E21B 23/00* (2006.01)
*E16L 37/22* (2006.01)

(52) U.S. Cl. ..... 166/242.7; 166/384; 166/207; 166/242.6; 285/318; 285/305; 285/92

(58) Field of Classification Search ..... 285/318, 285/305; 166/242.7, 207, 242.6, 384; 185/92
See application file for complete search history.

(56) References Cited

U.S. PATENT DOCUMENTS

| | | | | |
|---|---|---|---|---|
| 268,686 | A * | 12/1882 | Kaiser | 285/305 |
| 1,678,640 | A | 7/1928 | Hall | |
| 1,820,644 | A | 8/1931 | Bach | |
| 2,226,804 | A | 12/1940 | Carroll | |
| 2,341,670 | A | 2/1944 | Stinson | |
| 2,407,552 | A | 9/1946 | Hoesel | |
| 2,751,238 | A * | 6/1956 | Vegren | 403/316 |
| 2,873,985 | A | 1/1959 | Baldwin | |
| 2,898,136 | A * | 8/1959 | Hall, Sr. et al. | 403/6 |
| 3,062,568 | A | 11/1962 | Andresen et al. | |
| 3,105,556 | A | 10/1963 | Raulins | |
| 3,419,079 | A | 12/1968 | Current | |
| 3,759,553 | A * | 9/1973 | Carter | 285/260 |
| 3,766,991 | A | 10/1973 | Brown | |
| 3,855,126 | A | 12/1974 | Smith | |
| 3,857,450 | A | 12/1974 | Guier | |
| 3,913,687 | A | 10/1975 | Gyongyosi et al. | |
| 3,989,284 | A | 11/1976 | Blose | |
| 4,076,280 | A | 2/1978 | Young | |
| 4,449,596 | A | 5/1984 | Boyadjieff | |
| 4,491,351 | A | 1/1985 | Galle, Jr. et al. | |
| 4,591,195 | A | 5/1986 | Chelette et al. | |
| 4,625,796 | A | 12/1986 | Boyadjieff | |
| 4,659,119 | A | 4/1987 | Reimert | |
| 4,703,959 | A | 11/1987 | Reeves et al. | |

(Continued)

FOREIGN PATENT DOCUMENTS

DE 3413792 11/1985

(Continued)

OTHER PUBLICATIONS

U.S. Appl. No. 09/762,410, filed Aug. 9, 1999, Metcalfe.

(Continued)

*Primary Examiner*—David Bagnell
*Assistant Examiner*—Giovanna M. Collins
(74) *Attorney, Agent, or Firm*—Patterson & Sheridan LLP

(57) ABSTRACT

The present invention generally relates to a connector arrangement for connecting a first tubular to a second tubular. In particular, the present invention relates to methods and apparatus for connecting the tubulars in such a way that the connection is prevented from becoming unmade in response to expansion of the tubulars. A connector mechanically mates a box end and a pin end of the tubulars together to form the connection. Additionally, mating castellations, surface finishes on the pin end and the box end, torque screws, and a variable pitch groove can provide resistance to relative rotation between the tubulars at the connection.

13 Claims, 8 Drawing Sheets

U.S. PATENT DOCUMENTS

| | | | | |
|---|---|---|---|---|
| 4,712,955 | A | 12/1987 | Reece et al. | |
| 4,754,807 | A | 7/1988 | Lange | |
| 4,771,829 | A | 9/1988 | Sparlin | |
| 4,793,422 | A | 12/1988 | Krasner | |
| 4,813,493 | A | 3/1989 | Shaw et al. | |
| 4,822,081 | A | 4/1989 | Blose | |
| 4,878,546 | A | 11/1989 | Shaw et al. | |
| 4,917,409 | A | 4/1990 | Reeves | |
| 4,985,975 | A | 1/1991 | Austin et al. | |
| 5,048,871 | A | 9/1991 | Pfeiffer | |
| 5,181,570 | A | 1/1993 | Allwin et al. | |
| 5,251,709 | A | 10/1993 | Richardson | |
| 5,339,895 | A | 8/1994 | Arterbury et al. | |
| 5,348,095 | A | 9/1994 | Worrall et al. | |
| 5,388,651 | A | 2/1995 | Berry | |
| 5,520,422 | A | 5/1996 | Friedrich et al. | |
| 5,743,333 | A * | 4/1998 | Willauer et al. | 166/122 |
| 5,782,503 | A | 7/1998 | Noel et al. | |
| 5,787,980 | A | 8/1998 | Sparlin et al. | |
| 5,855,242 | A | 1/1999 | Johnson | |
| 5,901,789 | A | 5/1999 | Donnelly et al. | |
| 5,906,398 | A | 5/1999 | Larsen et al. | |
| 5,924,745 | A | 7/1999 | Campbell | |
| 5,984,568 | A | 11/1999 | Lohbeck | |
| 6,012,522 | A | 1/2000 | Donnelly et al. | |
| 6,109,349 | A | 8/2000 | Simone et al. | |
| 6,158,507 | A | 12/2000 | Rouse et al. | |
| 6,158,785 | A | 12/2000 | Beaulier et al. | |
| 6,189,619 | B1 | 2/2001 | Wyatt et al. | |
| 6,273,634 | B1 | 8/2001 | Lohbeck | |
| 6,315,040 | B1 | 11/2001 | Donnelly | |
| 6,322,109 | B1 | 11/2001 | Campbell et al. | |
| 6,325,424 | B1 | 12/2001 | Metcalfe et al. | |
| 6,343,813 | B1 * | 2/2002 | Olson et al. | 285/305 |
| 6,409,175 | B1 | 6/2002 | Evans et al. | |
| 6,457,532 | B1 | 10/2002 | Simpson | |
| 6,543,816 | B1 | 4/2003 | Noel | |
| 6,581,980 | B1 * | 6/2003 | DeLange et al. | 285/334 |
| 6,607,220 | B2 * | 8/2003 | Sivley, IV | 285/334 |
| 6,685,236 | B2 | 2/2004 | Setterberg | |
| 2001/0038206 | A1 * | 11/2001 | Olechnowicz et al. | 285/328 |
| 2002/0070031 | A1 | 6/2002 | Voll et al. | |
| 2002/0163192 | A1 | 11/2002 | Coulon et al. | |
| 2003/0024708 | A1 | 2/2003 | Ring | |
| 2003/0168858 | A1 | 9/2003 | Hashem | |
| 2003/0234538 | A1 | 12/2003 | Hashem | |
| 2004/0017081 | A1 | 1/2004 | Simpson | |

FOREIGN PATENT DOCUMENTS

| | | | |
|---|---|---|---|
| EP | 0 659 975 | A2 | 6/1995 |
| EP | 0 803 637 | A2 | 10/1997 |
| EP | 0171 144 | A1 | 10/1997 |
| FR | 2742177 | | 6/1997 |
| GB | 2 099 529 | A | 12/1982 |
| GB | 2 161 569 | A | 7/1985 |
| GB | 2 392 965 | | 3/2004 |
| JP | 2002286183 | | 10/2002 |
| WO | WO 90/11455 | | 10/1990 |
| WO | WO 93/12323 | | 6/1993 |
| WO | WO 96/37681 | A1 | 11/1996 |
| WO | WO 97/17524 | A2 | 5/1997 |
| WO | WO 98/22690 | | 5/1998 |
| WO | WO 98/32948 | | 7/1998 |
| WO | WO 98/42947 | A1 | 10/1998 |
| WO | WO 00/08301 | A2 | 2/2000 |
| WO | WO 03/048503 | | 6/2003 |
| WO | WO 03/048506 | | 6/2003 |

OTHER PUBLICATIONS

U.S. Appl. No. 10/443,664, filed Apr. 22, 2003, Ellington.
U.S. Appl. No. 10/663,351, filed Sep. 12, 2003, Ellington.
U.S. Appl. No. 10/664,584, filed May 22, 2003, Ellington.
U.S. Appl. No. 10/670,133, filed Sep. 24, 2003, Macauley et al.
GB 0221220.7 Search Report.
GB 0215668.5 Search Report.
GB 0222321.2 Search Report.
"Polytetrafluoroethylene", Encyclopedia Britannica; http://ww.search.eb.com/eb/article?eu=62273 [Accessed Oct. 22, 2002].
"Industrial polymers, major", Encyclopedia Britannica; http://ww.search.eb.com/eb/article?=62273 [Accessed Oct. 22, 2002].
U.K. Search Report, Application No. GB0328085.6, dated Apr. 27, 2004.

* cited by examiner

WIRE LOCK EXPANDABLE CONNECTION

BACKGROUND OF THE INVENTION

1. Field of the Invention

The present invention generally relates to tubular connections. In particular, the present invention relates to a method of connecting tubulars in such a way that the connection is prevented from becoming unmade in response to expansion of the tubulars. More particularly, the present invention relates to tubular connections that use a connector to mechanically mate a box end of a first tubular with a pin end of a second tubular.

2. Description of the Related Art

In order to access hydrocarbons in subsurface formations, it is typically necessary to drill a bore into the earth. The process of drilling a borehole and of subsequently completing the borehole in order to form a wellbore requires the use of various tubular strings. These tubulars are typically run downhole where the mechanical and seal integrity of the jointed connections are critically important in the original make-up of the tubulars, during expansion of the tubulars, and after expansion of the tubulars.

Typically threaded connections are used to connect multiple tubular members end-to-end. This is usually accomplished by providing tubulars that have a simple male to female threaded connection. The male end is generally referred to as a pin, and the female end as a box. The tubulars are connected, or "made-up," by transmitting torque against one of the tubulars while the other tubular is typically held stationary. Torque is transmitted in a single direction in accordance with the direction corresponding with connection make-up. Any torque applied to the joint in the make-up direction will have the effect of continuing to tighten the threaded joint.

When running tubulars there is sometimes a requirement to run jointed tubulars that will later be expanded by various types of expansion mechanisms. The most basic type of expander tool employs a simple cone-shaped body which is run into a wellbore at the bottom of the casing which is to be expanded. The expander tool is then forced upward in the wellbore by both pulling on the working string from the surface and applying pressure below the cone. A basic arrangement of a conical expander tool is disclosed in U.S. Pat. No. 5,348,095, issued to Worrall, et al., in 1994 and that patent is incorporated herein in its entirety. Pulling the expanded conical tool has the effect of expanding a portion of a tubular into sealed engagement with a surrounding formation wall, thereby sealing off the annular region therebetween. More recently, rotary expander tools have been developed. Rotary expander tools employ one or more rows of compliant rollers which are urged outwardly from a body of the expander tool in order to engage and to expand the surrounding tubular. The expander tool is rotated downhole so that the actuated rollers can act against the inner surface of the tubular to be expanded in order to expand the tubular body circumferentially. Radial expander tools are described in U.S. Pat. No. 6,457,532 and that patent is incorporated herein by reference in its entirety.

Tubulars to be later expanded are typically run downhole where the mechanical and seal integrity of the connections, or joints, are critically important both in the original and expanded state of the tubulars. The current method of making-up expandable tubulars is by the design of modified threaded connections which can be applied and handled in the same way as conventional oil-field tubulars, i.e., stabbed into each other and screwed together by right hand or left hand rotation and finally torqued to establish the seal integrity. This method of connecting tubulars, though a reliable means of connecting non-expanding tubulars, is proving to be problematic when these tubulars are expanded. The reasons for this being mainly due to the changes in geometry of the connection during expansion due to the stresses applied at the threads, or joint area. For instance, conventional tubulars expanded at the joint may disengage allowing the lower tubing to fall into the wellbore.

It is well known and understood that during the expansion of solid all tubulars, the material in the tubing wall is plastically deformed in more than just the circumferential sense. In order for a tubular to increase in diameter by plastic deformation, the material to make-up the additional circumferential section of wall in the larger diameter must come from the tubing wall itself either by reduction in wall thickness or by reduction in tubular length or a combination of both. In a plain wall section of the tubular this process will normally take place in a relatively controlled and uniform way. However, at the point of a threaded connection, or joint, the changes in wall section, which are required in order to form an expandable threaded connection, introduce very complex and non-uniform stresses during and after expansion. These during-expansion stresses significantly change the thread form and compromise the connection integrity both in terms of its mechanical strength as well as in terms of its sealing capability. Specifically, elongation along the thread helix may result in a thinning of the thread profile perpendicular to the thread helix.

Additionally, due to the changes in geometry of the threads during expansion, thread jumping may also be an issue. Further, the larger elastic deformation caused by the reduced sections of the tubing wall at the roots of the thread will introduce much higher stresses than in other areas of the expanded tubular. This in turn may lead to joint failure due to these stresses approaching or exceeding the ultimate strength of the tubing material or by introduction of short cycle fatigue caused by the cyclic nature of some expansion processes being applied at these high stress levels.

Therefore, there exists a need for a tubular connection that can withstand torque and is prevented from becoming unmade during expansion of the tubular. There exists a further need for a connection that has a higher yield strength than that of the tubular body, or pipe wall. There exists still a further need for a connection that is free to move along its profile relative to the tubular wall during expansion of the tubular.

SUMMARY OF THE INVENTION

The present invention generally relates to tubular connections that can resist torque and maintain a connection after expansion within a wellbore. In accordance with the invention, a metal insert or connector, preferably a high tensile wire, is placed within a cavity formed between corresponding machined grooves of a first tubular and a second tubular after make-up. Depending upon wellbore characteristics, the connector may be coated with Teflon, an inert sealant, or other material known to those in the art for sealing purposes.

In operation, the connector is inserted through a slot in a wall of one tubular and into the continuous cavity, this cavity being the product of the alignment of matching groove patterns machined into a box portion and a pin portion of the tubulars. In a preferred embodiment, the slot or opening is milled through the wall of the box. The slot is further milled to align with an end of the recessed groove profile of that tubular. The groove is preferably helical in nature; however, multiple individual grooves, with individual insertion points, spaced out axially on the connection can also achieve the same desired effect. Since the groove is not limited to a radiused profile, it can be dovetail in shape, square, or have an infinite number of possible profiles.

Once the groove on the box aligns with the groove on the pin, the connector, preferably a wire that has a higher tensile strength than that of the box or pin, is inserted into the slot and along the recessed groove profile, that is through the continuous cavity. Essentially, the connector becomes the carrying mechanism between the box and the pin similar to the threads in a conventional threaded connection.

Reducing or eliminating relative rotation of the pipe on either side of the connection can be accomplished by a number of different embodiments. First, cutting variable pitch grooves on both the box and the pin can address these torque issues. In so doing, the two tubulars can not disengage when the box is rotated relative to the pin due to the immediate mismatch in the connector grooves unlike a normal threaded connection. Alternatively, the tubulars can possess castellated, or toothed, ends that essentially lock the tubular ends together. In this manner, the tubular walls possess a corresponding number of locking recesses and keys that resist torque once the connection is made. Further yet, the connection can employ close tolerance fits in conjunction with a variety of different surface finishes between the two mating parts. Therefore, torque has to then overcome the friction that develops between the two pieces. Still further yet, screws that engage both tubulars can be used to couple the two tubulars together. A further embodiment applies a combination of the embodiments described above.

In order to mitigate thinning of the inserted connector, partial cuts may be made on the inserted connector along its entire length. This causes the connector to separate into a multitude of shorter sections without compromising the cross section of the connector during expansion.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
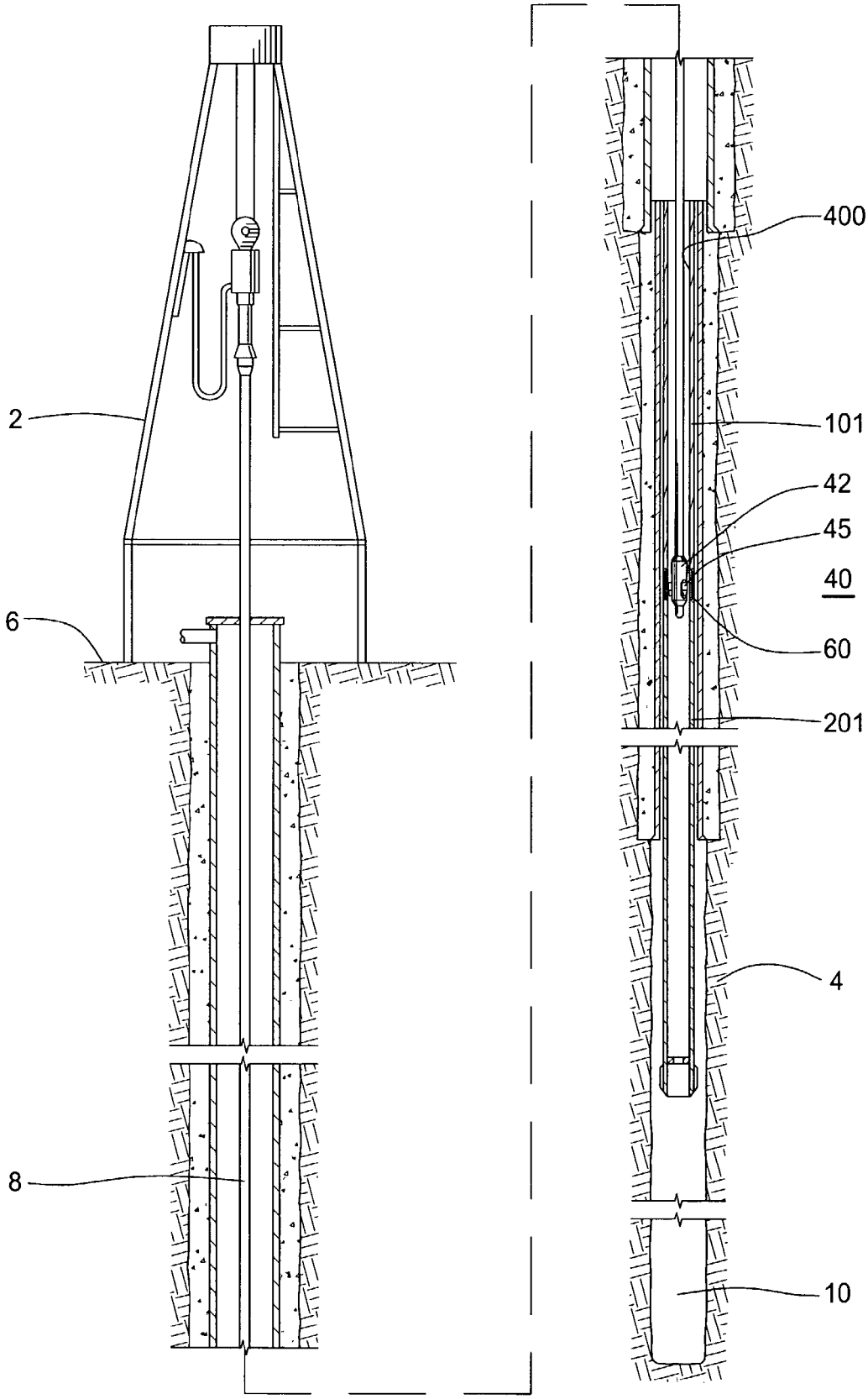
FIG. 1 is an elevation view schematically showing tubulars within a borehole and a representative expander tool at a joint between two tubulars.

FIG. 1 illustrates an embodiment of the present invention in use within a wellbore 10. Visible in FIG. 1 is a representative rig 2, a ground surface 6, a formation 4, a drill string or running string 8, a first tubular 101, a second tubular 201, a representative expander tool 40 comprising a body 42 and an expansion member 45 or roller, a bore 400 running through the tubulars, and a connection 60 or joint, between the first tubular 101 and the second tubular 201.

In operation, the first tubular 101 and the second tubular 201 are mated together at the surface 6 with the only deviation from normal stab-in and threading procedures being that of adding a connector (not shown) into a continuous cavity formed by matching recessed grooves (not shown) of the tubulars 101, 201 as described in detail later in the specification. The stab-in procedure can be preformed with tubulars arranged in a pin up and a box down configuration or a configuration with the pin down and the box up. After run-in, the tubulars can be expanded from within by any method known to those skilled in the art. The expansion process can be run in any axial and/or rotational direction within the tubulars 101, 201. As shown, a running tool with an expander element 40 or tool attached thereto is run up the bore 400 of the tubulars. At a desired location, an operator expands the tubulars. When the expander tool 40 reaches the connection 60 between the first tubular 101 and the second tubular 201, an internal wall of the pin portion of the second tubular 201 expands into the higher tensile strength connector (not shown) and dissipates force into a wall of the box portion of the first tubular 101. The connection 60 between the tubulars 101, 201 is capable of being expanded without losing its mechanical or sealing integrity. The connector insert (not shown) that is located between the recessed grooves of the two tubulars 101, 201 does not thin or plastically deform in the same degree as the tubulars 101, 201.

Figure 2:
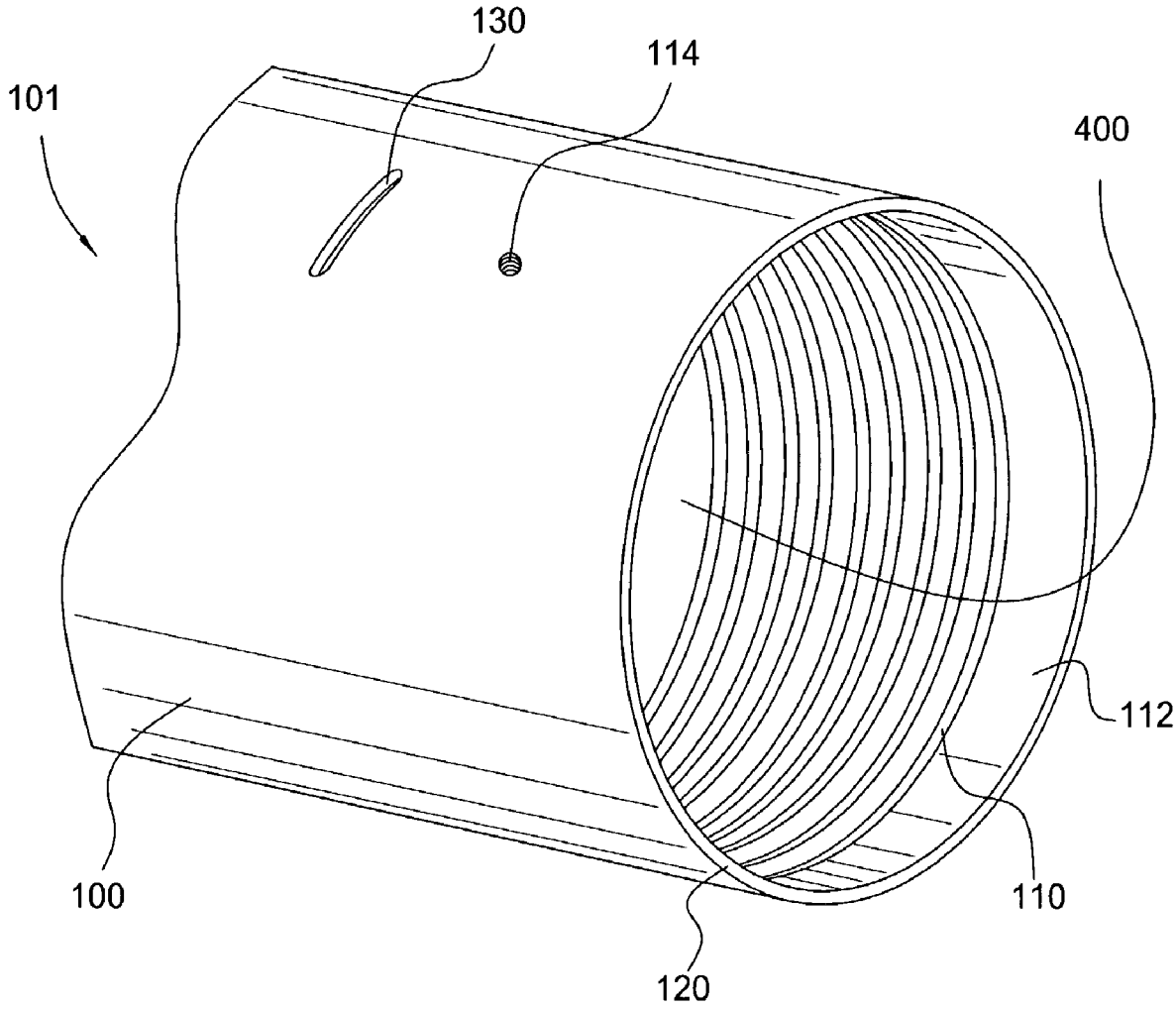
FIG. 2 is an isometric view of an embodiment of a box end of a tubular with a recessed groove on an interior wall of the box end of the tubular and a slot in a wall of the box end of the tubular.
Figure 3:
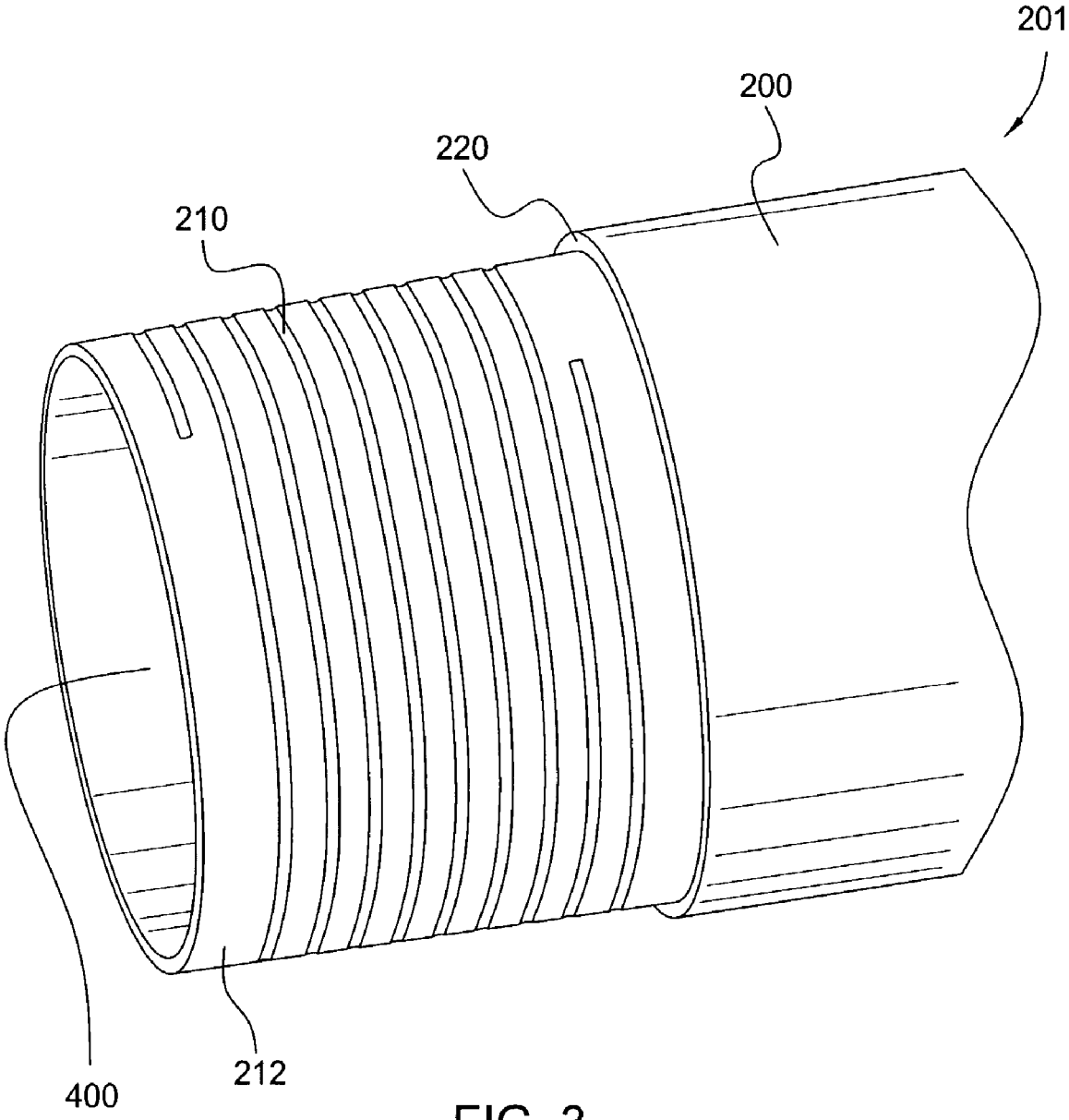
FIG. 3 is an isometric view of an embodiment of a pin end of a tubular with a corresponding recessed groove on an exterior wall of the pin end of the tubular.

FIG. 2 is an isometric view of a box end 100 of a first tubular 101. As shown, an inside diameter of the box end 100 comprises a recessed groove 110. As further shown, a wall of the box end 100 includes a slot 130 or opening that a connector (not shown) may be inserted through. The slot 130 allows insertion of the connector along the recessed groove 110. Consequently, the slot 130 is preferably in alignment with the recessed groove 110. FIG. 3 is an isometric view of a pin end 200 of a second tubular 201. As shown, an outside diameter of the pin end 200 comprises a corresponding recessed groove 210 that matches the profile of the groove 110 of the box end 100 (shown in FIG. 2). The grooves 110, 210 shown in FIG. 2 and FIG. 3 are an example of a radius groove that is circular in nature; however, the grooves 110, 210 can have any number of different profiles such as multiple individual grooves 110 axially separated with individual insertion slots 130 or grooves 110, 210 that are dovetail in shape or square.

Figure 4:
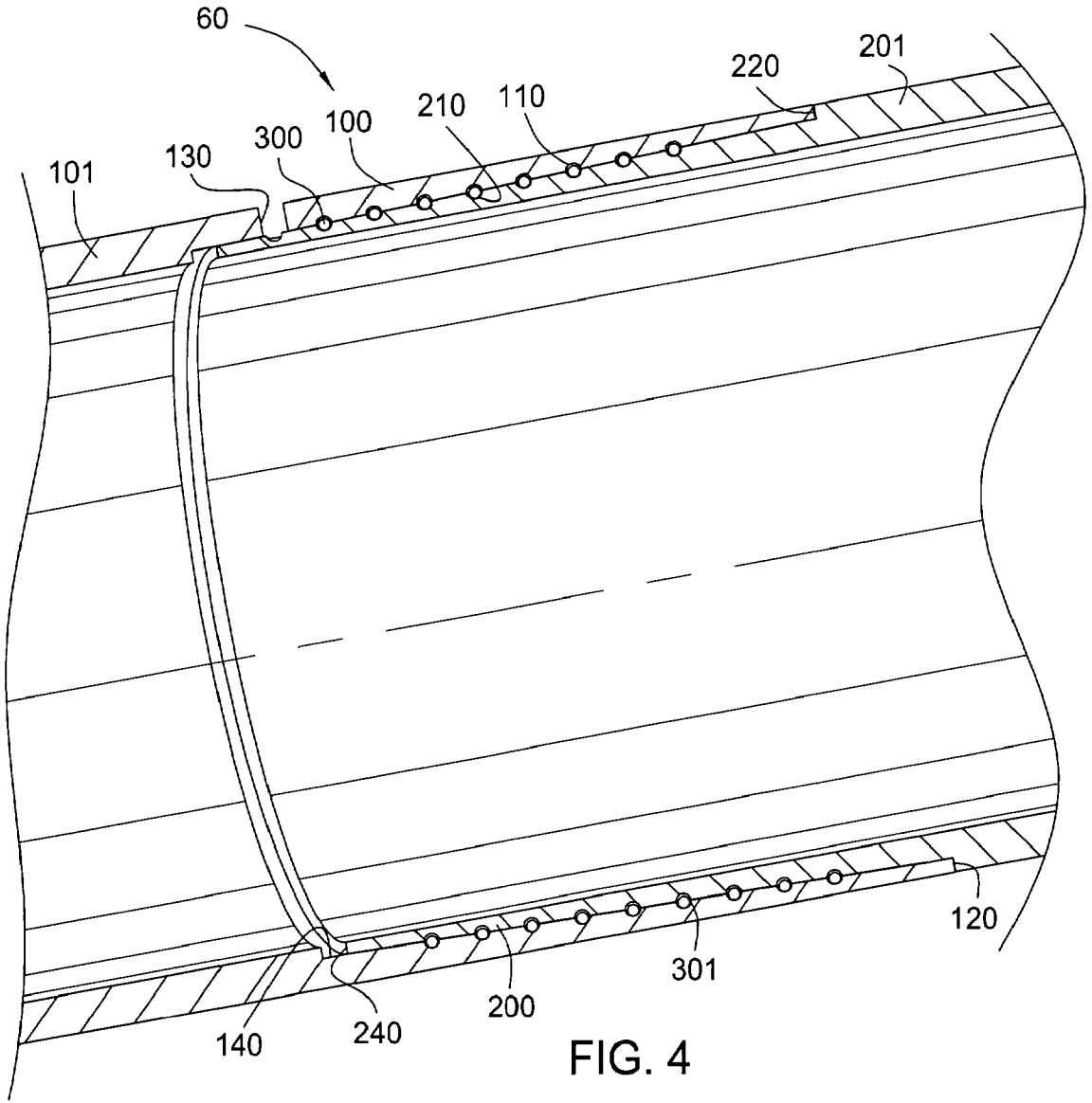
FIG. 4 is a cross-sectional view of the tubulars shown in FIG. 2 and FIG. 3 in a mated or stabbed-in position.

FIG. 4 is a cross-sectional view of the first tubular 101 shown in FIG. 2 and the second tubular 201 shown in FIG. 3 in a mated or stabbed-in position. As shown, the pin end 200 can have a tapered outside diameter that mates with a tapered inside diameter of the box end 100 in order to increase a carrying capacity of the connection 60. In operation, the pin end 200 stabs into the box end 100 of the adjoining first tubular 101 and the corresponding groove 210 aligns with the recessed groove 110 on the box end 100 to form a continuous cavity 301, or closed pathway, that a connector 300, or wire, may be placed within. When the pin end 200 stabs into the box end 100, an end 120 of the box end 100 contacts a shoulder 220 of the pin end 200 to allow for alignment of the grooves 110 on the box end 100 with the corresponding grooves 210 on the pin end 200, such that the connector 300 can be inserted. To further aid in aligning the grooves 110, 210, identifying marks or locating tabs (not shown) such as alignment arrows may be placed on an exterior of the tubulars 101, 201 so that when a mark of the second tubular 201 is in linear alignment with a mark on the first tubular 101 an operator would know that the grooves 110, 210 of the two tubulars 101, 201 are in alignment and the continuous cavity 301 exists.

An inside surface 112 (see FIG. 2) of the box end 100 and an outside surface 212 (see FIG. 3) of the pin end 200 can comprise a finish that when mated as shown in FIG. 4 provides a frictional resistance between the box end 100 and the pin end 200 that prevents relative rotation between the first tubular 101 and the second tubular 201. Additionally, a torque screw 114 (see FIG. 2) in the box end 100 can engage the pin end 200 in order to prevent relative rotation between the first tubular 101 and the second tubular 201. The surface finishes and torque screws are examples of torque locking devices.

The connector 300 is preferably a wire with a higher tensile strength than that of the box end 100 and the pin end 200. The shape of the connector 300 preferably matches the shape of the cavity 301. Therefore, a cross section of the connector 300 can be round, square, dovetail or any shape matching the cavity 301. Additionally, partial cuts into the radius of the connector 300 and along the entire length of the connector 300 can be made in order to mitigate thinning of the connector 300 since the connector 300 separates at these partial cuts into a multitude of shorter sections without compromising the cross section of the connector 300 during expansion of the tubulars 101, 201.

Sealing arrangements (not shown) for use with the connection 60 are also envisioned. These sealing arrangements can include the use of a coating on the connector 300 such as a sealant, Teflon, or other material. The use of gaskets or o-rings comprised of an elastomer, some other non-metallic material, or a metallic material positioned between the pin end 100 and the box end 200 can provide a seal. Additionally, a metal to metal seal between an end 240 of the pin end 200 and an inside portion 140 of the box end 100 can provide a seal.

After the connector 300 is inserted into the cavity 301, it is possible that a portion of the connector 300 will extend out of the slot 130 (shown in FIG. 2). For run-in, this portion of the connector 300 can be cut or machined in order to achieve a flush tubular exterior. A set screw (not shown) may be used to seal the slot 130 (shown in FIG. 2) once the connector 300 is inserted. In operation, this is achieved by having the slot 130 pre-tapped in order to receive the set screw. Additionally, the box end 100 can include trapping profiles (not shown) on an outside diameter of the box end 100 adjacent the slot 130 in order to clip the end of the connector 300 out of the way.

Figure 5A:
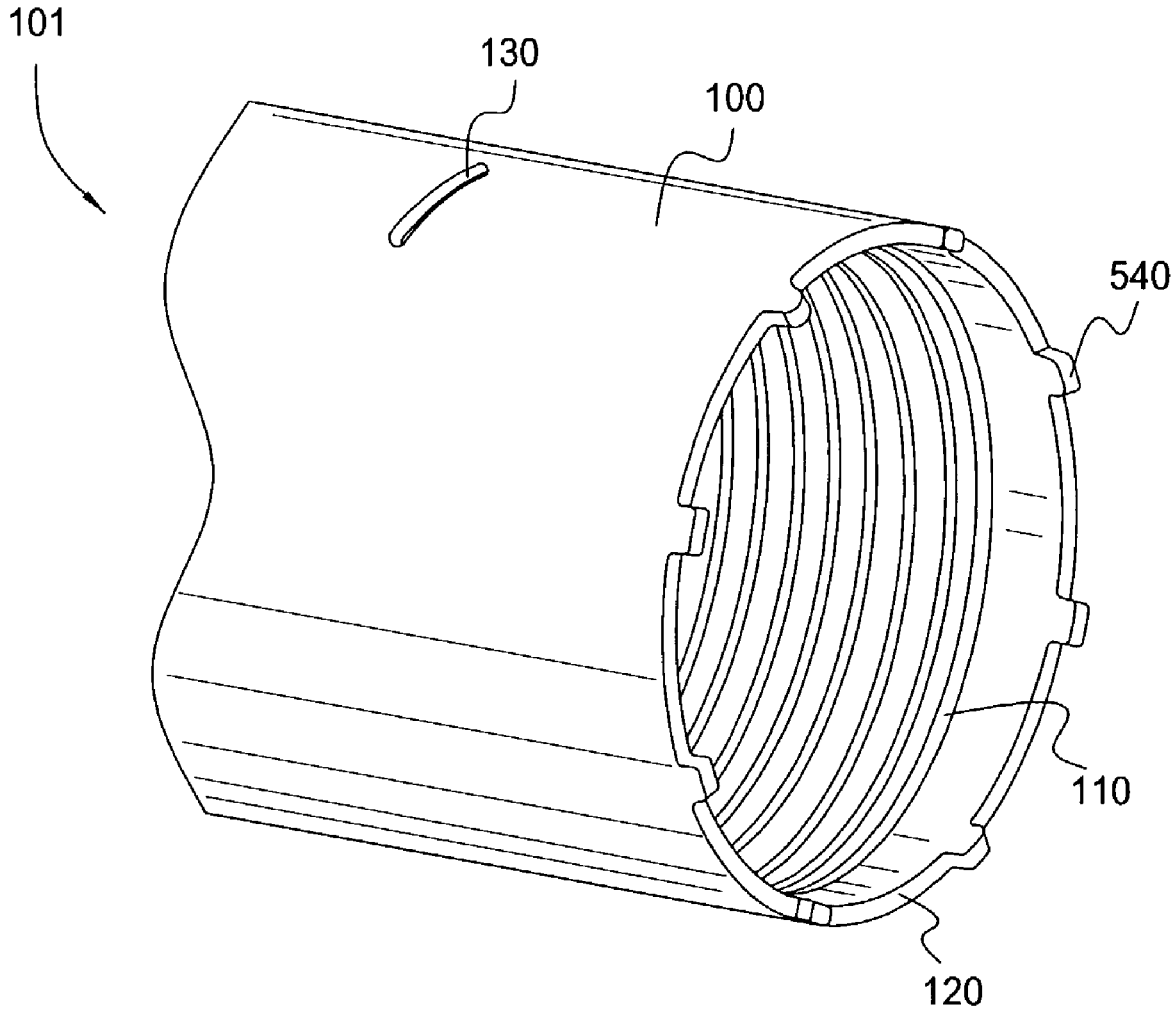
FIG. 5A is a view of another embodiment of a box end that has castellations.
Figure 5B:
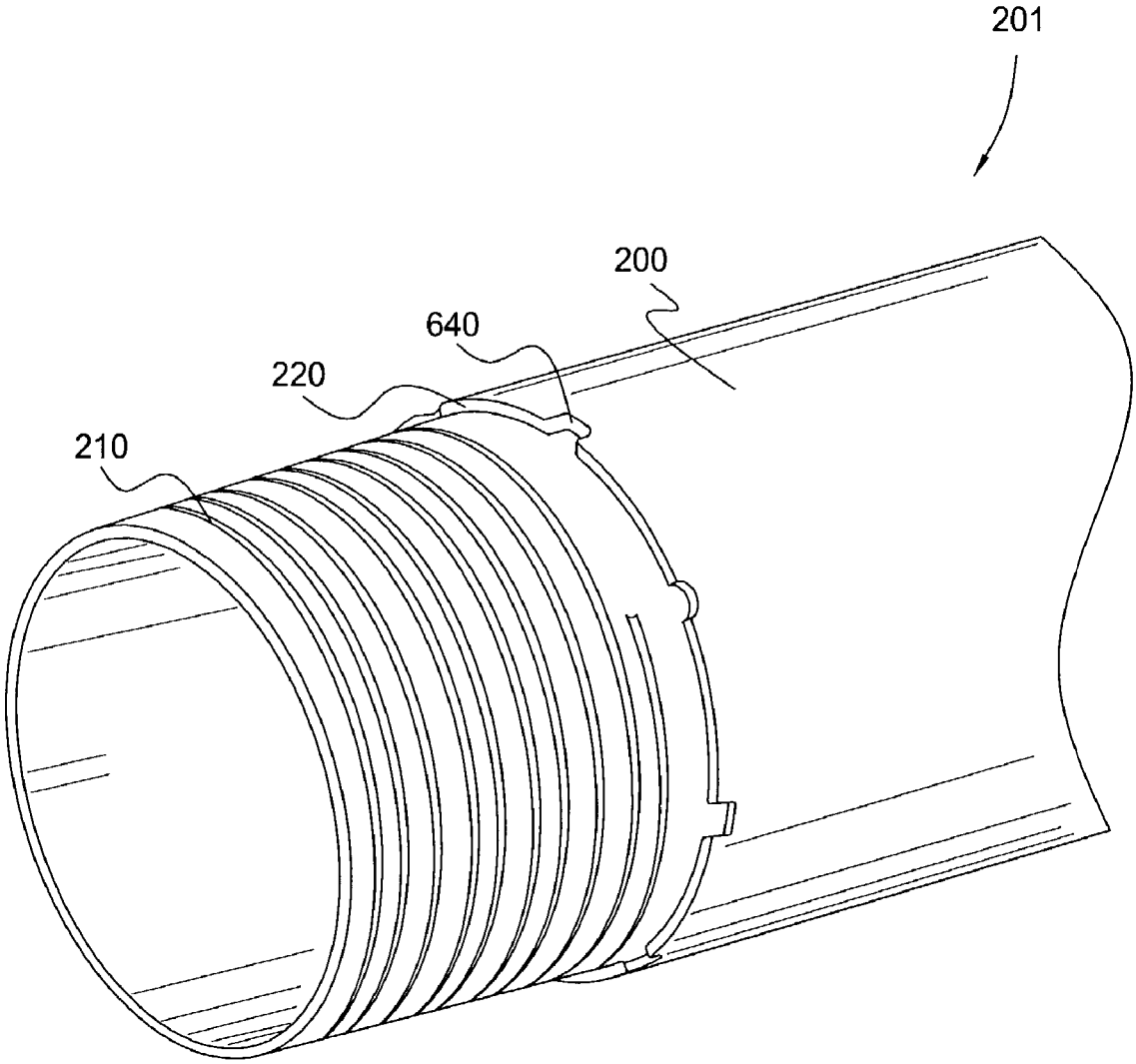
FIG. 5B is a view of another embodiment of a pin end that has mating castellations.

FIG. 5A and FIG. 5B are views of another embodiment of the present invention. FIG. 5A depicts a box end 100 of a first tubular 101 similar to the box end shown in FIG. 2 with the addition of castellations 540 on an end 120 of the box end 100. FIG. 5B depicts a pin end 200 of a second tubular 201 similar to the pin end shown in FIG. 3 with the addition of mating castellations 640 on a shoulder 220. Therefore, incorporating that from above provides a connection between the tubulars 101, 201 that resists rotation between the tubulars 101, 201 due to the castellations 540, 640. The castellations 540, 640 can be square shaped, toothed, or any shape capable of preventing rotational movement between the tubulars 101, 201 once the pin end 200 is stabbed into the box end 100 and the castellations 540 mate with the mating castellations 640. Therefore castellations 540, 640 are examples of torque locking devices.

Figure 6:
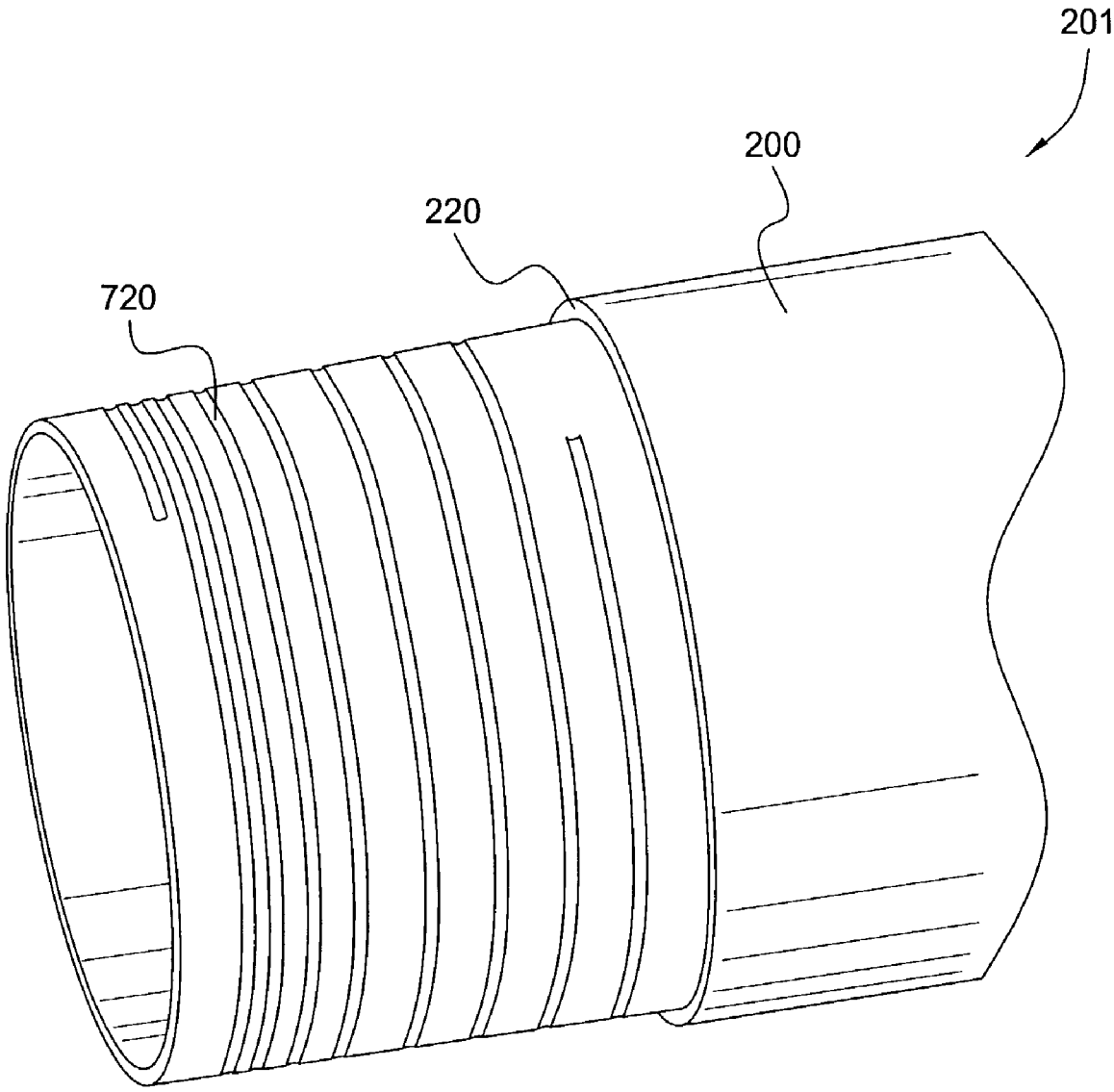
FIG. 6 is a view of another embodiment of a pin end that has a variable pitch groove.

FIG. 6 is an isometric view of another embodiment of the present invention. Visible in FIG. 6 is a pin end 200 of a second tubular 201 with a variable pitch groove 720. Similar to the connection described in FIG. 4, the pin end 200 mates with a box end of a first tubular (not shown) that has a corresponding variable pitch groove within the box end in order to form a continuous cavity with a variable pitch. Therefore, a connector positioned within the continuous cavity with the variable pitch resists rotational movement between the tubulars. Unlike conventional threaded tubulars that cannot be fitted with variable pitch threads, the use of the connector between the two tubulars allows the connection formed using the embodiment shown in FIG. 6 the ability to resist torque. Therefore, the variable pitch groove 720 itself provides another example of a torque locking device.

Figure 7A:
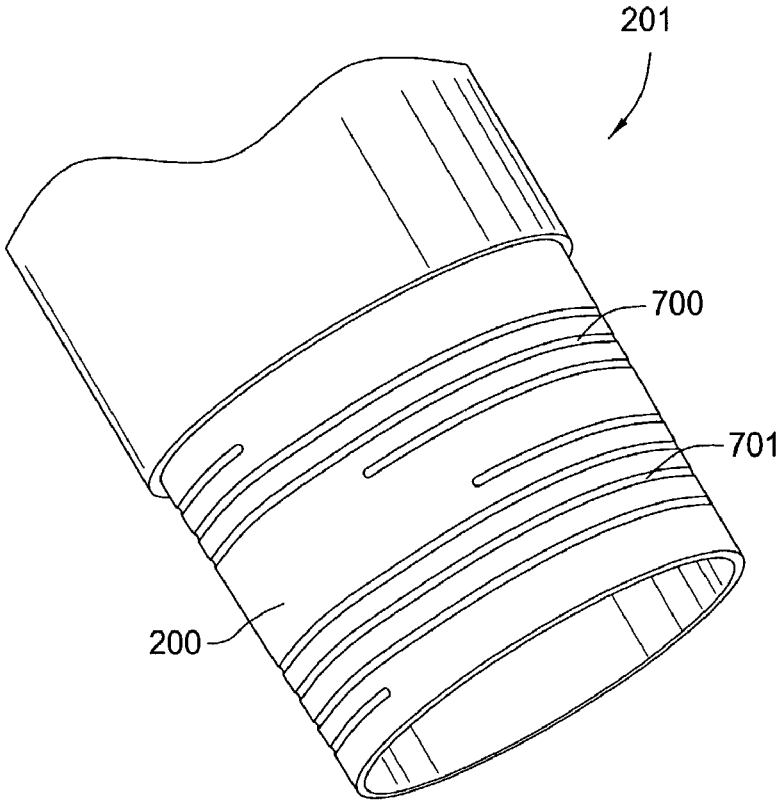
FIG. 7A is a view of another embodiment of a pin end with a right hand helix recess and a left hand helix recess.
Figure 7B:
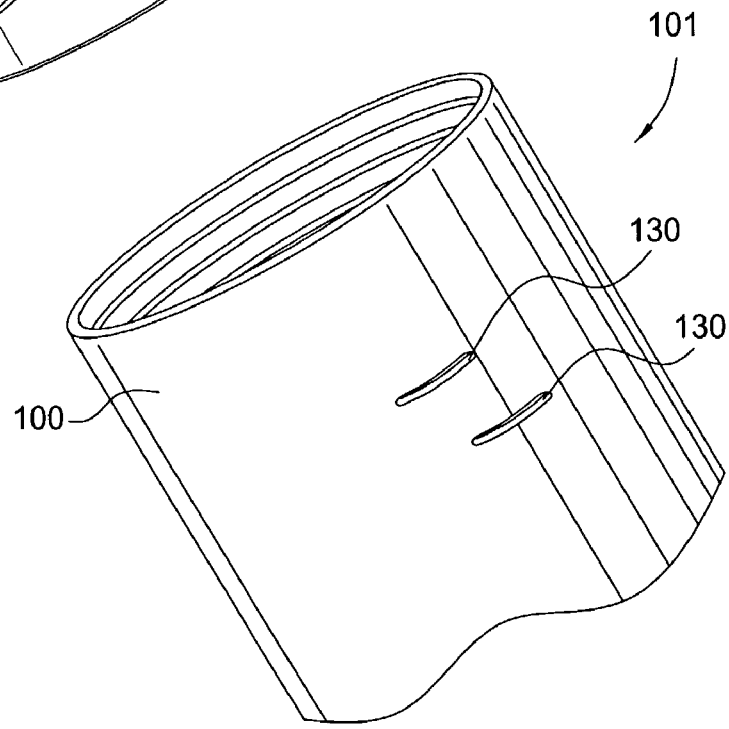
FIG. 7B is a view of another embodiment of a box end for mating with the pin end shown in FIG. 7A.

Additionally, FIG. 7A and FIG. 7B illustrate another embodiment of the present invention that uses two or more separated recesses with alternating helixes to connect a first tubular 101 with a second tubular 201. As shown in FIG. 7A, a pin end 200 of the second tubular 201 has a first groove 700 that forms a right hand helix and a second groove 701 that forms a left hand helix. In addition to the first groove 700 and second groove 701, there can be additional independent alternating helix grooves. FIG. 7B illustrates a box end 100 of the first tubular 101 with multiple slots 130 in order to allow insertion of connectors (not shown) into each of the grooves 700, 701. Using separate grooves 700, 701 with alternating helixes prevents relative rotation between the first tubular 101 and the second tubular 201. Therefore, the grooves 700, 701 with alternating helixes provide another example of a torque locking device.

The connection arrangements shown above are but an example of a connector of the present invention. Other arrangements and embodiments may be utilized within the spirit and scope of the present invention. As such, while the foregoing is directed to embodiments of the present invention, other and further embodiments of the invention may be devised without departing from the basic scope thereof, and the scope thereof is determined by the claims that follow.

What is claimed is:

1. A method for connecting a first and a second tubular, comprising:

stabbing the first tubular into the second tubular to align a variable pitched groove formed on an inside of an end of the first tubular with a corresponding variable pitched groove formed on an outside of an end of the second tubular to form a variable pitched continuous recess through the variable pitched grooves;

positioning a connector member into at least a portion of the continuous recess to provide a connection between the tubulars; and expanding at least a portion of the connection radially outward, wherein resistance to relative rotation between the tubulars is maintained after expansion.

2. The method of claim 1, wherein a seal between the tubulars is maintained after expansion.

3. The method of claim 1, further including running the connection into a wellbore.

4. The method of claim 1, further including expanding a portion of one tubular with an expander device having at least one radially extendable member.

5. The method of claim 1, wherein the connector member severs into at least two pieces upon expansion of the connection.

6. The method of claim 1, further including locking the connector member in the continuous groove by a torque locking device.

7. The method of claim 1, further including mating at least one castellation in the first tubular with at least one castellation of the second tubular.

8. An expandable connection for a wellbore tubular comprising:

a first tubular member having a variable pitched groove formed on an inside surface thereof;

a second tubular member having a variable pitched groove formed on an outside surface thereof, wherein the tubular members are mateable to form a variable pitched continuous recess through the variable pitched grooves; and an aperture formed in a wall of the first tubular, the aperture provides a pathway for inserting a connector member into the variable pitched continuous recess, whereby the connector member rotationally and axially fixed the first tubular member to the second tubular member.

9. The expandable connection of claim 8, wherein the first tubular has at least one castellation for mating with at least one castellation of the second tubular.

10. The expandable connection of claim 8, wherein the tubular members include a finish that provides frictional resistance to rotational movement between the tubular members upon expansion thereof.

11. The expandable connection of claim 8, wherein the connector member is coated with a sealant.

12. The expandable connection of claim 8, wherein the connector member has a least one section that severs upon expansion of the connection.

13. The expandable of connection of claim 8, further conprising at least one torque locking device for securing the connector member in the continuous recess.

* * * * *